US005537836A

United States Patent [19]

Ricketts

[11] Patent Number: 5,537,836

[45] Date of Patent: Jul. 23, 1996

[54] REFRIGERANT RECOVERY UNIT

[76] Inventor: William H. Ricketts, P.O. Box 1982, Muskogee, Okla. 74402

[21] Appl. No.: 283,033

[22] Filed: Jul. 9, 1994

[51] Int. Cl.[6] ..... F25B 45/00

[52] U.S. Cl. ..... 62/149; 62/292

[58] Field of Search ..... 62/77, 85, 149, 62/292, 475

[56] References Cited

U.S. PATENT DOCUMENTS 5,182,918 2/1993 Manz et al. ..... 62/292

5,189,881 3/1993 Miles ..... 62/77

*Primary Examiner*—John M. Sollecito

*Attorney, Agent, or Firm*—Frank J. Catalano; Scott R. Zingerman

[57] ABSTRACT

A refrigerant recovery unit is provided in which four distinct refrigerant flow paths are automatically controlled by the unit components to perform four separate and distinct functions. In a liquid refrigerant path, liquid refrigerant is recovered from the discharge side of a disabled unit through the refrigerant recovery unit by use of the differential pressure between the disabled unit and the refrigerant receiving can. In a primary vapor path, evacuation of gaseous refrigerant from the high and low sides of the disabled unit is achieved by use of a compressor in the recovery unit which produces a differential pressure to induce flow. This differential pressure is produced solely by the recovery unit compressor until such time as the intake pressure of the compressor reaches approximately 4 inches Hg. vacuum. When the compressor intake pressure reaches 4 inches Hg. vacuum, the system automatically switches to a secondary vapor path for recovering gaseous refrigerant from the high and low side of the disabled unit by sequencing an external vacuum pump in series with the compressor of the recovery unit to produce the differential pressure inducing flow. This differential pressure is continued until the intake pressure reaches a desired vacuum level of up to 29.9 inches Hg. Finally, to recover gaseous refrigerant or non-condensible gas from the high and low side of the disabled unit after the desired vacuum level has been reached, differential pressure is obtained by connecting the external vacuum pump through the recovery unit without using the compressor. This same path can be used to remove non-condensible gas from a receiving can as well.

18 Claims, 5 Drawing Sheets

REFRIGERANT RECOVERY UNIT

BACKGROUND OF THE INVENTION

This invention relates generally to methods and apparatus for servicing refrigeration systems and more particularly concerns the recovery of refrigerants from such systems without release of refrigerant to the atmosphere.

Predecessors to the present refrigerant recovery system are disclosed in my earlier U.S. Pat. No. 5,320,224 and patent application Ser. No. 134,045, soon to be issued as a patent. While the previous systems perform quite well in that the series arrangement of vacuum pump and compressor facilitates achievement of a deep vacuum in the disabled unit, a cryogenic type of pressure regulator was required to protect the vacuum pump. As a result, while otherwise unachievable vacuum levels for this kind of equipment were obtained, the operation of the system was slowed considerably.

In addition, in switching earlier refrigerant recovery systems from liquid to vapor evacuation, three-way valves requiring manual operation were employed. In some applications, when the operator failed to switch the valve from liquid to vapor flow before starting the compressor, the result was severe damage to the compressor.

Moreover, none of the earlier systems, regardless of their efficiency, permitted evacuation of the repaired disabled unit to the atmosphere through the same vacuum pump that had been used to evacuate the unit for repair. This lack further increased complexity of and time on the job.

At the same time, solutions to these problems give rise to a variety of difficulties in devising a refrigerant recovery unit useable to recover both liquid refrigerant and gaseous refrigerant from a disabled unit, to evacuate a refrigerant receiving can and to evacuate the repaired disabled unit and the recovery unit to a deep vacuum.

It is, therefore, an object of this invention to provide a refrigerant recovery unit capable of performing the evacuation of liquid and gaseous refrigerant from the disabled unit as well as the evacuation of receiving cans and of the refrigerant recovery unit itself. It is also an object of this invention to provide a refrigerant recovery unit capable of performing this multitude of functions with the gaseous refrigerant evacuation process proceeding at faster rates than in earlier systems. It is another object of this invention to provide a refrigerant recovery system which automatically transfers from the liquid recovery to the gaseous recovery flow conditions when the condenser is switched on. And it is an object of this invention to provide a refrigerant recovery unit which permits evacuation of a repaired refrigeration unit to the atmosphere using the same vacuum pump used during the refrigerant evacuation process prior to repair.

SUMMARY OF THE INVENTION

In accordance with the invention, a refrigerant recovery unit is provided in which four distinct refrigerant flow paths are automatically controlled by the unit components to perform four separate and distinct functions. In a liquid refrigerant path, liquid refrigerant is recovered from the discharge side of a disabled unit through the refrigerant recovery unit by use of the differential pressure between the disabled unit and the refrigerant receiving can. In a primary vapor path, evacuation of gaseous refrigerant from the high and low sides of the disabled unit is achieved by use of a compressor in the recovery unit which produces a differential pressure to induce flow. This differential pressure is produced solely by the recovery unit compressor until such time as the intake pressure of the compressor reaches approximately 4 inches Hg. vacuum. When the compressor intake pressure reaches 4 inches Hg. vacuum, the system automatically switches to a secondary vapor path for recovering gaseous refrigerant from the high and low side of the disabled unit by sequencing an external vacuum pump in series with the compressor of the recovery unit to produce the differential pressure inducing flow. This differential pressure is continued until the intake pressure reaches a desired vacuum level of up to 29.9 inches Hg. Finally, to recover gaseous refrigerant or non-condensible gas from the high and low side of the disabled unit after the desired vacuum level has been reached, differential pressure is obtained by connecting the external vacuum pump through the recovery unit without using the compressor. This same path can be used to remove non-condensible gas from a receiving can as well. Since the vacuum pump is sequenced into operation with the compressor, the need for the cryogenic type pressure regulator to protect the pump is eliminated and the speed of the gaseous refrigerant's evacuation process is accelerated to approximately one-sixth (⅙) the time of previously known units.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
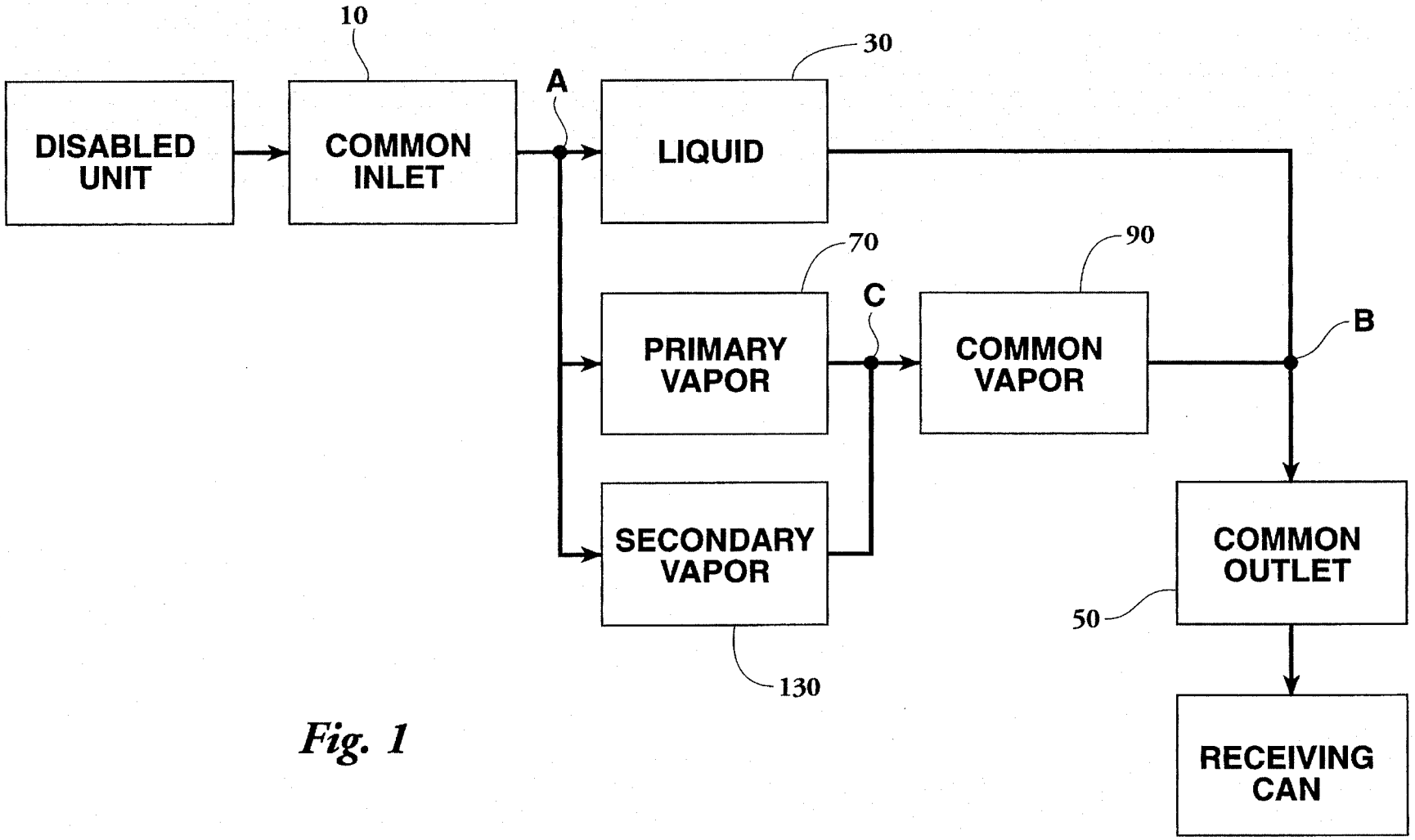
FIG. 1 is a block diagram of a preferred embodiment of the improved refrigerant recovery unit.

Turning to FIG. 1, the basic flow paths for the evacuation of refrigerant from a disabled unit to a receiving can are illustrated. Refrigerant passes from the disabled unit into a common inlet path 10 and from the common inlet path 10 to a flow path branch point A. From branch point A, refrigerant in the liquid form flows through a liquid path 30 and then via a branch point B through a common outlet path 50 which is connected to the receiving can. If the refrigerant is in a gaseous state, it will flow from the branch point A through a primary vapor path 70 to a branch point C at which it is directed to a common vapor path 90 which in turn connects to the branch point B entering into the common outlet path 50 which also receives the liquid refrigerant. In the primary vapor path 70, refrigerant is evacuated to a first predetermined vacuum level. When this level has been reached, flow automatically transfers from the branch point A through a secondary vapor path 130 to the branch point C and thence through the common vapor path 90 to branch point B and the common outlet path 50. In the secondary vapor path 130, refrigerant can be evacuated to a second predetermined vacuum level significantly deeper than the first predetermined vacuum level.

Figure 2:
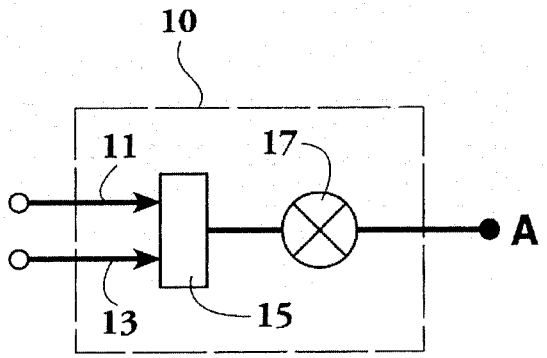
FIG. 2 is a schematic diagram of the preferred embodiment of the common inlet flow path of the refrigerant recovery unit.

Looking at FIG. 2, the components of the common inlet path 10 are illustrated in greater detail. In this path, a first hose 11 is connected from the high side of the disabled unit compressor and a second hose 13 connected from the low side of the disabled unit compressor. These hoses 11 and 13 are then connected to the high side and low side ports, respectively, of the manifold gauge 15. A sight glass and filter dryer are mounted on the manifold gauge 15 which is then connected to the inlet side of a recovery unit intake valve 17. The outlet side of the intake valve 17 is connected to the flow path branch point A of the recovery unit.

Figure 3:
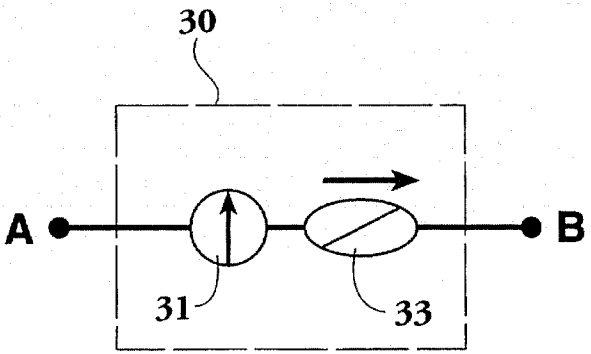
FIG. 3 is a schematic diagram of a preferred embodiment of the liquid flow path of the refrigerant recovery unit.

Looking at FIG. 3, the components of the liquid flow path 30 of the recovery unit are shown in greater detail. From the branch point A, the flow path 30 is connected to a low side pressure gauge 31 and thence to a check valve 33 which is in turn connected to flow path branch point B of the recovery unit.

Figure 4:
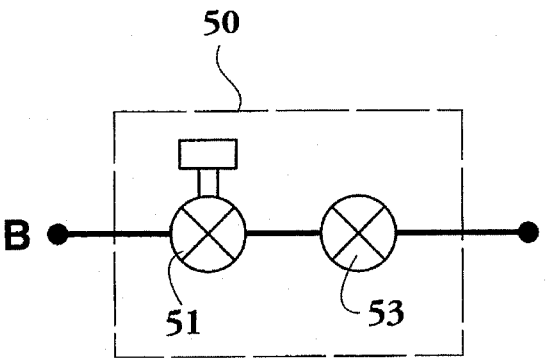
FIG. 4 is a schematic diagram of a preferred embodiment of the common outlet flow path of the refrigerant recovery unit.

As shown in FIG. 4, the components of the common outlet path 50 of the recovery unit extend from the flow path branch point B and include a solenoid valve 51 connected in series through a discharge valve 53 to the receiving can intake.

Figure 5:
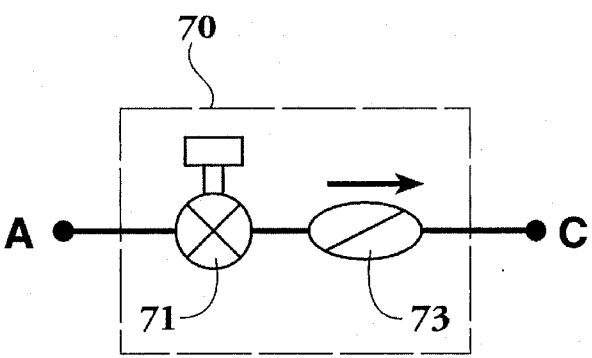
FIG. 5 is a schematic diagram of a preferred embodiment of the primary vapor flow path of the refrigerant recovery unit.

Looking at FIG. 5, the components of the primary vapor path 70 of the recovery unit extend from the flow path branch point A and include a second solenoid valve 71 in series with a second check valve 73 to flow path branch point C of the recovery unit.

Figure 6:
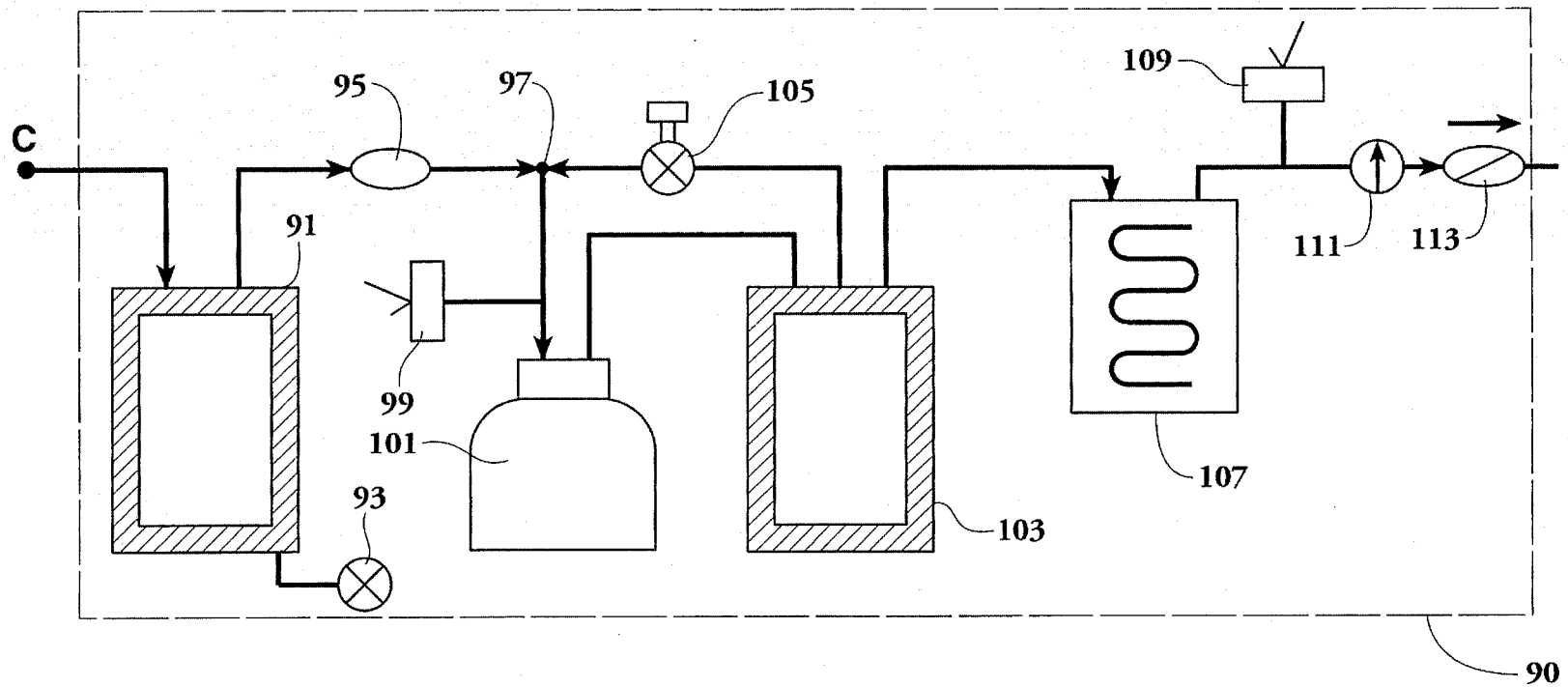
FIG. 6 is a schematic diagram of a preferred embodiment of the common vapor flow path of the refrigerant recovery unit.

The components of the common vapor path 90 are illustrated in greater detail in FIG. 6. From flow path branch point C of the recovery unit, gaseous refrigerant flows into an oil separator 91 which has an oil drain valve 93 for removal of oil collected in the separator 91. From the separator 91 gaseous refrigerant continues to flow through a pressure regulator 95 to a T-connector 97. From the T-connector 97, the pressure is monitored by a high pressure switch 99 set at approximately 4 inches Hg. vacuum as the gaseous refrigerant continues to flow to the compressor 101. From the compressor 101 flow continues to the oil return separator 103. From the oil return separator 103, oil return can be accomplished through another solenoid valve 105 which connects the separator 103 back to the T-connector 97. Normally the refrigerant flows from the oil return separator 103 to a condensing coil 107 after which it is monitored by an approximately 420 psig pressure switch 109 as flow continues through a high side pressure gauge 111 and thence through a check valve 113 to the flow path branch point B of the recovery unit.

Figure 7:
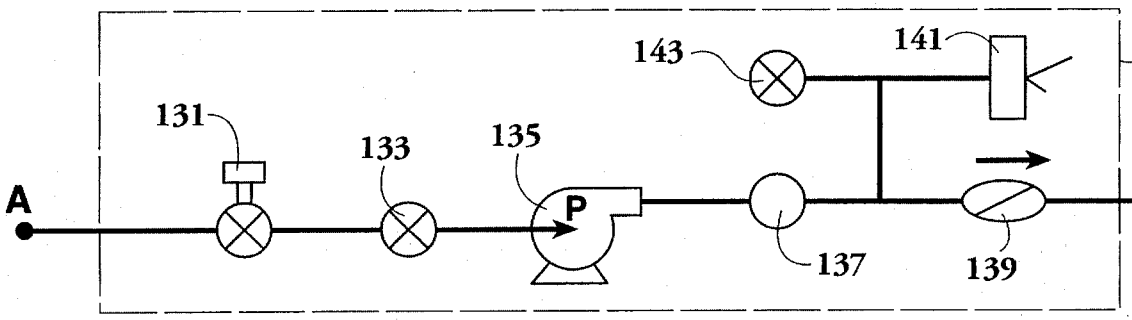
FIG. 7 is a schematic diagram of a preferred embodiment of the secondary vapor path of the refrigerant recovery unit.

The components of the secondary vapor path 130 are illustrated in greater detail in FIG. 7. As shown, from flow path branch point A of the recovery unit, gaseous refrigerant flows through a solenoid valve 131 and thence through an intake valve 133 which is connected to the intake port of a vacuum pump 135. Since the vacuum pump 135 is a relatively cumbersome piece of equipment and since disabled unit owners often have a suitable vacuum pump 135 available on site, the vacuum pump 135 is typically external to the refrigerant recovery unit. From the discharge port of the vacuum pump 135, flow of gaseous refrigerant continues through a port 137 to the vacuum pump discharge and then to another check valve 139 which in turn is connected to the flow path branch point C of the recovery unit. Between the port 137 and the check valve 139, an approximately 20 psig switch 141 and a vacuum pump valve 143 useable to vent the vacuum pump discharge to the atmosphere are connected.

Figure 8:
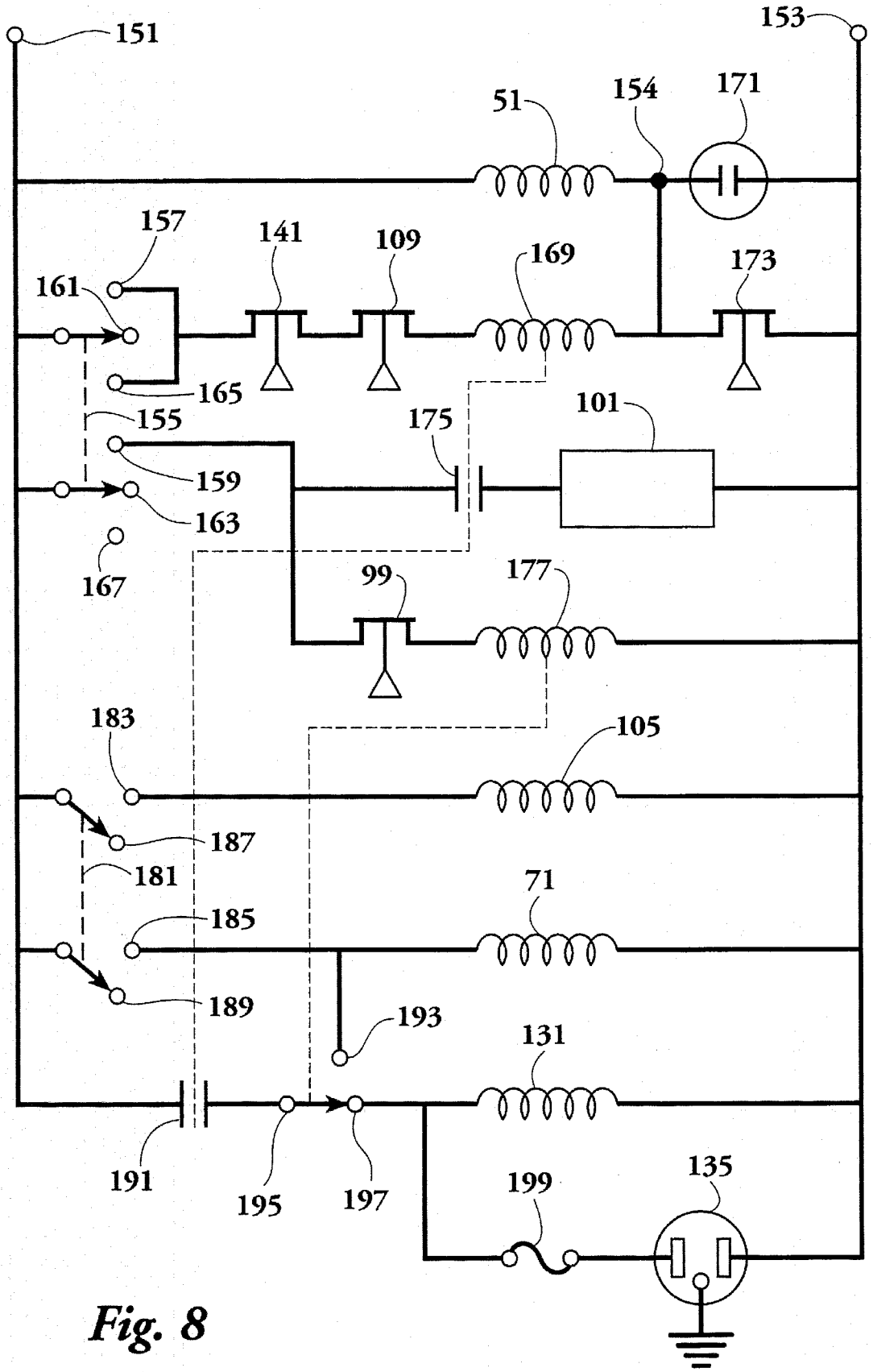
FIG. 8 is a schematic diagram of a preferred embodiment of the electrical system of the refrigerant recovery unit.
Figure 9:
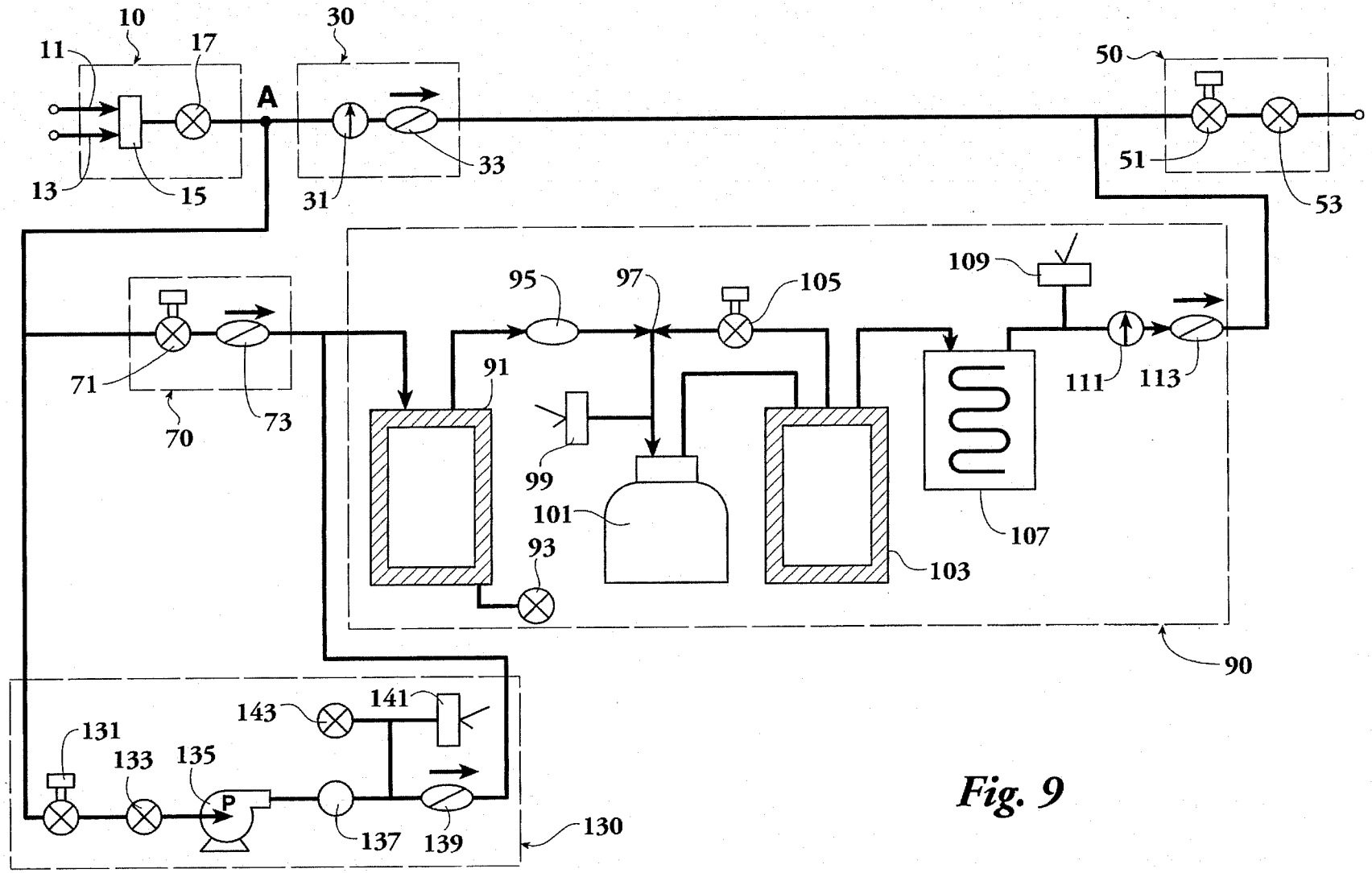
FIG. 9 is a schematic diagram of the unit of FIG. 1

Turning now to FIG. 8, the electrical system of the recovery unit is illustrated. As shown, first and second conductors 151 and 153 provide power to the system from a 115 AC source (not shown). The circuit includes the coil of the outlet flow path solenoid valve 51 connected at one end to the first conductor 151 and at the other end to a common point 154. A double pole, double throw power switch 155 is variably selectable between first and second RECOVER positions 157 and 159, first and second OFF positions 161 and 163, and first and second VACUUM positions 165 and 167. The first RECOVER position 157 and first VACUUM position 165 are connected in common to the 20 psig pressure switch 141 in the secondary vapor path 130 and then in series with the 420 psig pressure switch 109 in the common vapor path 90 and the main coil 169 of the circuit which is in turn connected to the common point 154 on the output side of the coil of the outlet flow path; solenoid valve 51. The common point 154 is then connected through a neon light 171 to the second conductor 153. A bottle switch 173 is connected in parallel with the neon light 171. The second RECOVER terminal 159 of the power switch 155 is connected in series to a contact 175 operated by the main coil 169, to the electrical circuit of the compressor 101 and fan (not shown) and then to the second conductor 153. Connected in parallel with the contact 175 and the circuit of the compressor 101 and fan is a series arrangement of the 4 inch Hg. vacuum switch 99 of the common vapor path 90 and a vacuum relay coil 177. A second switch 181 connected to the first conductor 151 has first and second ON positions 183 and 185, respectively, and first and second OFF positions 187 and 189, respectively. The first ON terminal 183 is connected through the coil of the solenoid valve 105 in the common vapor path 90 to the second conductor 153. The second 0N terminal is connected through the coil of the solenoid valve 71 in the primary vapor path 70 to the second conductor 153. In addition, the second on position of the switch 181 is connected in parallel with a series connection of a contact 191 of the main coil 169 in series with a first position 193 of another switch 195. A second position 197 of the switch 195 is connected through the coil of the solenoid 131 in the secondary vapor path 130 of the recovery unit to the second conductor 153. Connected in parallel with the coil of the solenoid valve 131 in the secondary vapor path is a series arrangement of a breaker 199 and a power source receptacle for the vacuum pump 135 of the secondary vapor path 130. The breaker 199 protects the internal circuits when the vacuum pump 135 is activated.

To connect the recovery unit between the disabled unit or other refrigerant source and the receiving can or other refrigerant receptacle, the sight glass and filter dryer associated with the manifold 1,5 are connected together and mounted to the recovery unit intake valve 17. The hoses 11 and 13 are connected between the compressor of the disabled unit and the manifold 15 and another hose connected between the manifold gauge 15 and the intake valve 17. Another hose is connected between the recovery unit discharge valve 53 and the vapor valve of the receiving can. In addition, a safety cord (not shown) is connected to a safety switch on the receiving can (not shown). The power conductors 151 and 153 are then connected via the power cord (not shown) to the 115 volt power supply (not shown). This completes the basic connection of the recovery unit between the disabled unit and the receiving can.

To complete connection of the system, the vacuum pump 135, which is ordinarily external to the system, must also be connected. A first hose is connected between the vacuum port intake 133 and the vacuum port of the vacuum pump 135. A second hose is connected between the discharge port of the vacuum pump 135 and the port 137 to vacuum pump discharge. The vacuum pump 135 is then plugged into the vacuum pump power source receptacle as shown in FIG. 8. The intake valve 133 is then turned on and the vacuum pump. switch (not shown) is turned to the ON position. This completes the vacuum pump connection to the system.

In operation, after the system is connected, the high side valve (not shown) between the disabled unit and the manifold gauge 15 is opened. The intake valve 17 and the discharge valve 53 on the recovery unit are also opened, as is the vapor valve (not shown) on the receiving can. All valves on the refrigerant hoses will also be open. If the neon light 171 shows ON in this condition, this indicates that either the receiving can safety cord (not shown) is not properly connected, that the receiving can is not in upright condition, or that the receiving can is eighty percent (80%) full. When appropriate corrective action has been taken, the neon light should be in the OFF condition and the bottle switch 173 associated with the receiving can will be closed. Thus the coil of the solenoid valve 51 in the outlet flow path 50 will be energized and the solenoid valve 51 is in the open condition so that refrigerant in the liquid state will rush from the disabled unit to the receiving can as a result of the differential pressure between the disabled unit and the receiving can. By checking the sight glass associated with the manifold 15, it can be determined whether the flow of liquid refrigerant has ceased. If flow has ceased, the low side valve (not shown) on the disabled unit and the manifold are opened and the power switch 155 is moved from its OFF positions 161 and 163 to its RECOVER positions 157 and 159. The 20 psig switch 141 and the 420 psig switch 109 are closed, and therefore the main coil 169 is energized. This in turn causes the compressor main contact 175 to close, thus energizing the compressor circuit 101. At the same time, the vacuum relay switch 99 being closed, the vacuum relay 177 will also be energized. The vacuum pump switch 195 is operated by the vacuum relay 177 and is normally in its second position 197. However, when the vacuum relay 177 is energized, the switch 195 is pulled into its first position 193. Since the contact vacuum pump 191 will also be closed because the main coil 169 is energized, in this condition the coil of the solenoid valve 71 is also energized, opening the primary vapor path solenoid 71 to permit flow through the primary vapor path 70 and the common vapor path 90 to the flow path branch point B. As flow proceeds through the primary vapor path 70, the reading on the low side gauge 31 will recede toward a vacuum. When the low side gauge 31 nears 0 psig the, vacuum switch 99 which is set to operate at 4 inches Hg vacuum will open, de-energizing the vacuum relay coil 177 which in turn permits the vacuum control switch 195 to drop into its second position 197, de-energizing the coil of the solenoid valve 71 in the primary vapor path 70 and energizing the coil of the solenoid valve 131 in the secondary vapor path 110. At the same time, if the breaker 199 is closed, power will be available at the vacuum pump power source receptacle, and the vacuum pump 135 will be energized. Thus flow will be discontinued through the primary vapor path 70 and be initiated through the secondary vapor path 130 so that the vacuum pump 135 and the compressor 101 will pull in series together to increase the vacuum applied to the disabled unit. When a deep vacuum has been pulled to the desired level, the power switch 155 can be returned to the OFF condition and all valves closed to complete the evacuation process.

If it is necessary to discontinue operation of the refrigerant recovery unit during the recovery cycle, it may be necessary to wait two or three minutes before restarting the cycle to allow the compressor 101 time to reset. If, after restarting the recover cycle, the compressor 101 does not start, the power switch 155 should be turned off. The second switch 181 should then be turned to the ON or DUMP positions 183 and 185. The coils of the solenoid valves 71 and 105 in the primary vapor path 70 and the common vapor path 90 will then be energized and the pressure will equalize across the compressor 101. It is recommended that the switch 181 be activated to the ON or DUMP positions 183 and 185 before each start so that oil will be returned via the solenoid valve 105 from the oil separator 103 and pressure will be equalized across the compressor 101.

The recovery unit can remain hooked up between the disabled unit and the receiving can until all repairs are completed. At this point all valves will again be opened, except for the discharge valve 153. The valve 143 connecting the port 137 of the vacuum pump 135 to the atmosphere would also be opened. The power switch 155 is then moved to the first and second vacuum positions 165 and 167. In this condition, the compressor 101 is disconnected as is the vacuum relay 177. However, the main coil 169 is energized so that the vacuum pump contact 191 is closed and, since the switch 195 is in its second position 197, the coil of the solenoid valve 131 of the secondary vapor path is energized as is the vacuum pump 135, thus pulling a deep vacuum on the repaired unit. Once again, after the deep vacuum is reached, the power switch 155 is turned to the OFF condition and all valves are again closed.

If it is desirable to evacuate a receiving can, the vacuum pump 135 would be connected to the recovery unit as previously described. The hose can then be connected between the intake valve 17 on the recovery unit and the vapor valve on the receiving can. The safety cord (not shown) would also be connected to the safety switch (not shown) on the receiving can. The conductors 151 and 153 will again be connected to a power source (not shown) and the open-to-atmosphere valve 143 put in the open condition. The intake valve 17 and the vapor valve (not shown) are opened as are all valves on refrigerant hoses. The power switch 155 is then put into the first and second VACUUM positions 165 and 167 and the unit permitted to run until the receiving can reaches a deep vacuum in the range of approximately 29 inches Hg. The power switch 155 is then returned to the OFF positions 163 and 165 and all valves are closed. The hose to the intake valve 17 is disconnected.

If it is further desired to evacuate the recovery unit to zero after completing receiving can evacuation as above outlined, the hose is connected from the receiving can to the discharge valve 53 of the recovery unit. The safety cord is left connected to the receiving can and the power remains connected with the vacuum pump 135 in place. The discharge valve 53 and the discharge valve of the receiving can are then opened, and refrigerant from the high side of the recovery unit will flow into the receiving can. When refrigerant stops flowing, all valves are turned off, and the hose from the discharge valve 53 is disconnected.

To evacuate the recovery unit to 29 inches of Hg., after evacuating the recovery unit to zero, the hose from the receiving can is disconnected. One end of the hose is connected to the intake valve 17 and the other end of the hose to the discharge valve 53. Again, the safety cord is left connected to the receiving can and the power remains connected with the vacuum pump 135 in place. The vacuum-to-atmosphere valve 143 is opened as are the intake valves 17 and the discharge valve 53. The power switch 155 is again turned to the first and second vacuum positions 165 and 167, permitting the vacuum pump to run until the low side gauge 31 indicates that a vacuum in excess of 20 inches Hg. has been reached. The power switch is then turned to the OFF positions 163 and 165, and all valves are closed. All the refrigerant will now be evacuated from the recovery unit which can then be used to evacuate any of a number of refrigerants without contamination.

Thus, it is apparent that there has been provided, in accordance with the invention a refrigerant recovery unit that fully satisfies the objects, aims, and advantages set forth above. While the invention has been described in conjunction with specific embodiments and methods, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A refrigerant recovery unit comprising:

an intake valve;

an outlet flow path having a first solenoid valve and a discharge valve connected in series;

a liquid refrigerant flow path pneumatically communicating between said intake valve and said outlet flow path;

a primary vapor refrigerant flow path having a second solenoid valve therein and pneumatically communicating between said intake valve and a flow path branch point;

a secondary vapor refrigerant flow path having a third solenoid valve therein and adapted for series connection of a vacuum pump with said third solenoid valve and pneumatically communicating between said intake valve and said flow path branch point; and a common vapor refrigerant flow path having a compressor connected therein and pneumatically communicating between said flow path branch point and said outlet flow path, whereby, when said first solenoid valve is open and said second and third solenoid valves are closed, liquid refrigerant flows from said intake to said discharge valve through said liquid refrigerant flow path due to differential pressure between said intake and said discharge valves, when said first and second solenoid valves are open and said third solenoid valve is closed, vapor refrigerant flows from said intake to said discharge valve through said primary and common vapor refrigerant flow paths due to pressure caused by operation of said compressor, and, when said first and third solenoid valves are open and said second solenoid valve is closed, vapor refrigerant flows from said intake to said discharge valve through said secondary and common vapor refrigerant flow paths due to pressure caused by operation of both said compressor and said vacuum pump.

2. A refrigerant recovery unit according to claim 1, said first solenoid valve being opened in response to electrical connection of the recovery unit to an electrical power source.

3. A refrigerant recovery unit according to claim 2 further comprising means for sensing the unreadiness of a receptacle for receiving refrigerant from said discharge valve and for causing said first solenoid valve to be closed in response thereto.

4. A refrigerant recovery unit according to claim 1, said liquid refrigerant flow path having means therein for permitting flow from said intake valve to said discharge valve and for preventing flow from said discharge valve to said intake valve.

5. A refrigerant recovery unit according to claim 4, said liquid refrigerant flow path having a means therein for monitoring pressure between said check valve and said intake valve.

6. A refrigerant recovery unit according to claim 1, said primary vapor refrigerant flow path having means therein for permitting flow from said intake valve to said flow path branch point and for preventing flow from said flow path branch point to said intake valve.

7. A refrigerant recovery unit according to claim 1, said common vapor flow path having means for sensing pressure at an intake side of said compressor and means for sensing pressure at a discharge side of said compressor and said secondary vapor flow path having means for sensing pressure at a discharge side of said vacuum pump, said discharge side compressor and vacuum pump pressure sensing means further for enabling said second and third solenoid valves to be opened in response to electrical connection of the recovery unit to an electrical power source and the presence of a first predetermined pressure level at said compressor discharge side and a second predetermined pressure level at said vacuum pump discharge side and said intake side compressor pressure sensing means further for selectively causing said second and third solenoid valves to be opened and closed in response to vacuum less than and greater than a third predetermined pressure level at said compressor intake side, respectively.

8. A refrigerant recovery unit according to claim 7, said discharge side compressor and vacuum pump pressure sensing means further for energizing said compressor and for enabling said vacuum pump to be energized in response to said electrical connection of the recovery unit to an electrical power source and the presence of said first predetermined pressure level at said compressor discharge side and said second predetermined pressure level at said vacuum pump discharge side and said intake side compressor sensing means further for selectively causing said vacuum pump to be deenergized and energized in response to vacuum less than and greater than said third predetermined pressure level at said compressor intake side, respectively.

9. A refrigerant recovery unit according to claim 8, said third predetermined vacuum level being approximately 0 psig.

10. A refrigerant recovery unit according to claim 9, said first and second pressure levels being approximately 420 psig and 20 psig, respectively.

11. A refrigerant recovery unit according to claim 1, said common vapor refrigerant flow path further having an oil separator in series with an intake side of said compressor.

12. A refrigerant recovery unit according to claim 1, said common vapor flow path further having a condensing coil in series with an outlet side of said compressor.

13. A refrigerant recovery unit according to claim 12, said common vapor flow path having a means connected in series between said condensing coil and said outlet flow path for permitting flow from said condensing coil to said outlet flow path and for preventing flow from said outlet flow path to said condensing coil.

14. A refrigerant recovery unit according to claim 13, said common vapor flow path having a means for monitoring pressure and a switching means connected in series between said condensing coil and said flow permitting and preventing means, said switching means being responsive to pressure above a predetermined level to disconnect said compressor and said vacuum pump from an electrical power source thereto and to cause said second and third solenoid valves to be closed.

15. A refrigerant recovery unit according to claim 12, said common vapor flow path further having an oil return separator connected in series between said compressor and said condensing coil, an oil return path pneumatically communicating between said oil return separator and said intake side of said compressor, a fourth solenoid valve in said oil return path, means for selectively causing said fourth solenoid valve to be opened and closed and said compressor to be energized and deenergized, respectively, and means connected between said oil separator and said oil return path for permitting flow from said oil separator to said compressor and for preventing flow from said fourth solenoid valve to said oil separator.

16. A refrigerant recovery unit according to claim 1, said secondary vapor flow path further having means connected between said vacuum pump and said flow path branch point for permitting flow from said vacuum pump to said flow path branch point and for preventing flow from said flow path branch point to said vacuum pump.

17. A refrigerant recovery unit according to claim 16, said secondary vapor flow path further having a switching means connected between said vacuum pump and said flow permitting and preventing means, said switching means being responsive to pressure above a predetermined level to disconnect said compressor and said vacuum pump from an electrical power source thereto and to cause said second and third solenoid valves to be closed.

18. A refrigerant recovery unit according to claim 17, said secondary vapor flow path further having a discharge valve connected between an outlet side of said vacuum pump and the atmosphere.

* * * * *